US012734454B2

(12) United States Patent
Visconti

(10) Patent No.: US 12,734,454 B2
(45) Date of Patent: Sep. 15, 2026

(54) AMUSEMENT SLIDE CONTACT SURFACE

(71) Applicant: William Anthony Visconti, Hales Corner, WI (US)

(72) Inventor: William Anthony Visconti, Hales Corner, WI (US)

( * ) Notice: Subject to any disclaimer, the term of this patent is extended or adjusted under 35 U.S.C. 154(b) by 512 days.

(21) Appl. No.: 18/342,824

(22) Filed: Jun. 28, 2023

(65) Prior Publication Data

US 2025/0001317 A1 Jan. 2, 2025

(51) Int. Cl.
*A63G 21/02* (2006.01)

(52) U.S. Cl.
CPC ..... *A63G 21/02* (2013.01)

(58) Field of Classification Search
CPC ..... A63G 21/02
USPC ..... 472/88
See application file for complete search history.

(56) References Cited

U.S. PATENT DOCUMENTS

| | | | | | |
|---|---|---|---|---|---|
| 2,174,716 | A * | 10/1939 | Bethell | A63C 19/10 | 404/35 |
| 4,484,739 | A | 11/1984 | Kreinbihl | | |
| 5,810,376 | A * | 9/1998 | Matheny | B62B 15/008 | 280/87.021 |
| 11,077,378 | B2 | 8/2021 | Hunter | | |
| 11,117,060 | B2 * | 9/2021 | Sall | A63G 3/02 | |
| 11,998,854 | B1 * | 6/2024 | Schmit | C10M 125/04 | |
| 2003/0205872 | A1 * | 11/2003 | Mehrmann | B62B 15/00 | 280/28 |
| 2014/0194216 | A1 * | 7/2014 | Brassard | A63G 21/18 | 472/88 |
| 2016/0136527 | A1 * | 5/2016 | Hunter | A63G 7/00 | 472/88 |
| 2020/0354028 | A1 * | 11/2020 | Osborn | B63B 32/20 | |
| 2023/0129814 | A1 * | 4/2023 | Fallgatter | D06N 3/0011 | 472/116 |

* cited by examiner

*Primary Examiner* — Travis R Hunnings
(74) *Attorney, Agent, or Firm* — Ross Brandborg

(57) ABSTRACT

An amusement slide member with a rider sled that has a contact surface comprised of protrusions perpendicular to the sled bottom. This contact surface in combination with a low coefficient of friction slide surface makes for a low coefficient of friction between the rider sled and the slide.

6 Claims, 12 Drawing Sheets

AMUSEMENT SLIDE CONTACT SURFACE

RELATED APPLICATIONS

N/A

FEDERALLY SPONSORED RESEARCH

N/A

SEQUENCE LISTING OR PROGRAM

N/A

TECHNICAL FIELD OF THE INVENTION

The technical field of the present invention is in the construction and configuration of amusement slide assemblies.

Indoor entertainment facilities often lack the necessary ceiling height required for stairs and platforms, and the surfaces currently used in the market today do not have a low enough surface friction coefficient to allow users to achieve the needed exit velocity without lubricants. The present invention overcomes these challenges by reducing the drag coefficient between the sliding surface and the riding sled. This reduction in drag reduces the minimum required.

SUMMARY

The present invention provides a consistent and predictable experience for users. The invention lowers the drag coefficient when sliding therefore lowering the necessary height of the slide to achieve the desired speed. The slide assembly embodied in the present invention has a slide and a riding sled with surfaces that naturally maintains a minimum drag coefficient to reduce the needed height to operate, and does not impede the user's motion or momentum prior to the user reaching the lower bounds of the slide system.

BACKGROUND

Recreational or amusement slides have been used by children and adults for centuries, but consist of a rider and a sloped or inclined surface where gravity pulls the rider down the surface. There are also slides that use mechanical assistance to accelerate riders. In all slide configurations, there is some contact between the slide surface and either the rider themselves or a sled that the rider is positioned on. The present invention involves a slide-sled configuration with a low coefficient of friction.

In the world of indoor amusement slides, the quest for an exhilarating and enjoyable experience is paramount. One crucial factor that significantly influences the overall performance, safety, and satisfaction of riders is the coefficient of friction. In simple terms, the coefficient of friction is a measure of how easily two surfaces slide against each other, with a lower value indicating a smoother and faster slide. Achieving a low coefficient of friction in indoor amusement slides is of utmost importance, as it directly impacts the thrill factor, operational efficiency, and safety standards of these recreational attractions.

First and foremost, a low coefficient of friction enhances the thrill factor associated with indoor amusement slides. It allows for a swift and seamless glide, providing riders with an adrenaline-pumping experience as they effortlessly slide down the slope. This smooth and rapid motion is essential in maintaining the excitement of the ride, keeping guests coming back for more.

Additionally, a low coefficient of friction contributes to the operational efficiency of indoor amusement slides. By minimizing the resistance between the slide surface and the rider, the slides require less maintenance and can accommodate a higher volume of riders without compromising on performance. This translates to reduced downtime and increased profitability for the amusement facility.

Moreover, safety is a critical concern in the design and operation of indoor amusement slides, and a low coefficient of friction plays a vital role in ensuring a secure environment for riders. By allowing for a controlled and predictable sliding motion, it helps prevent accidents and injuries caused by excessive friction or abrupt stops. Furthermore, it enables the use of lighter and more comfortable sliding materials, reducing the likelihood of skin irritation or burns due to friction In conclusion, the importance of a low coefficient of friction in indoor amusement slides cannot be overstated. It directly influences the overall experience of riders by providing a thrilling, efficient, and safe sliding environment. By prioritizing the reduction of friction in the design and maintenance of these attractions, amusement facilities can ensure a memorable and enjoyable experience for their guests, ultimately contributing to their long-term success

BRIEF DESCRIPTION OF THE DRAWINGS

A complete understanding of the present invention is derived by referring to the detailed description and claims when considered in connection with the Figures.

Elements in the figures are illustrated for simplicity and clarity and are not necessarily rendered according to any particular slide configuration.

DETAILED DESCRIPTION OF THE DRAWINGS

Figure 1:
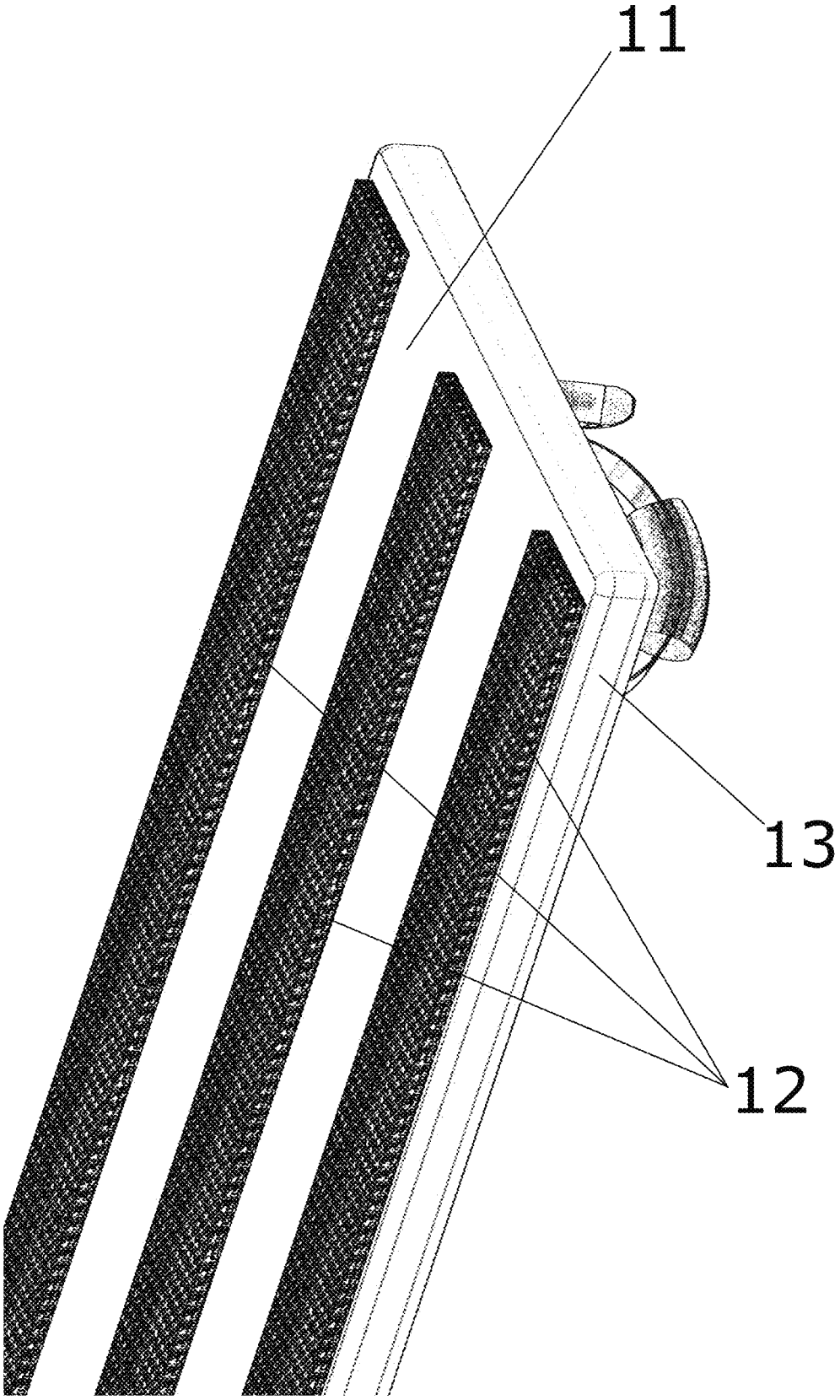

FIG. 1 is a bottom perspective view of one embodiment of a sliding sled.

Figure 2:
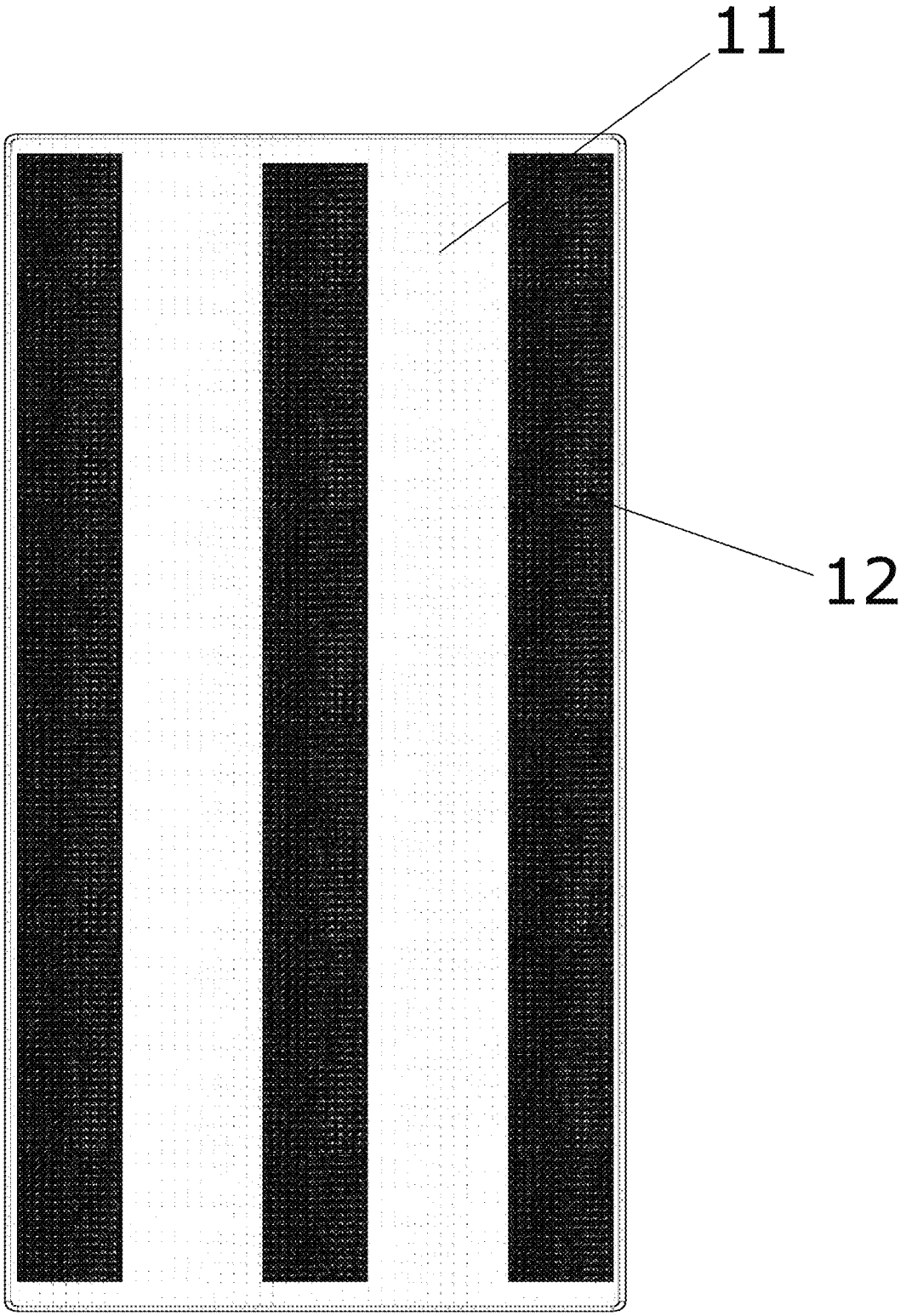

FIG. 2. is a bottom view of one embodiment of the sled.

Figure 3:
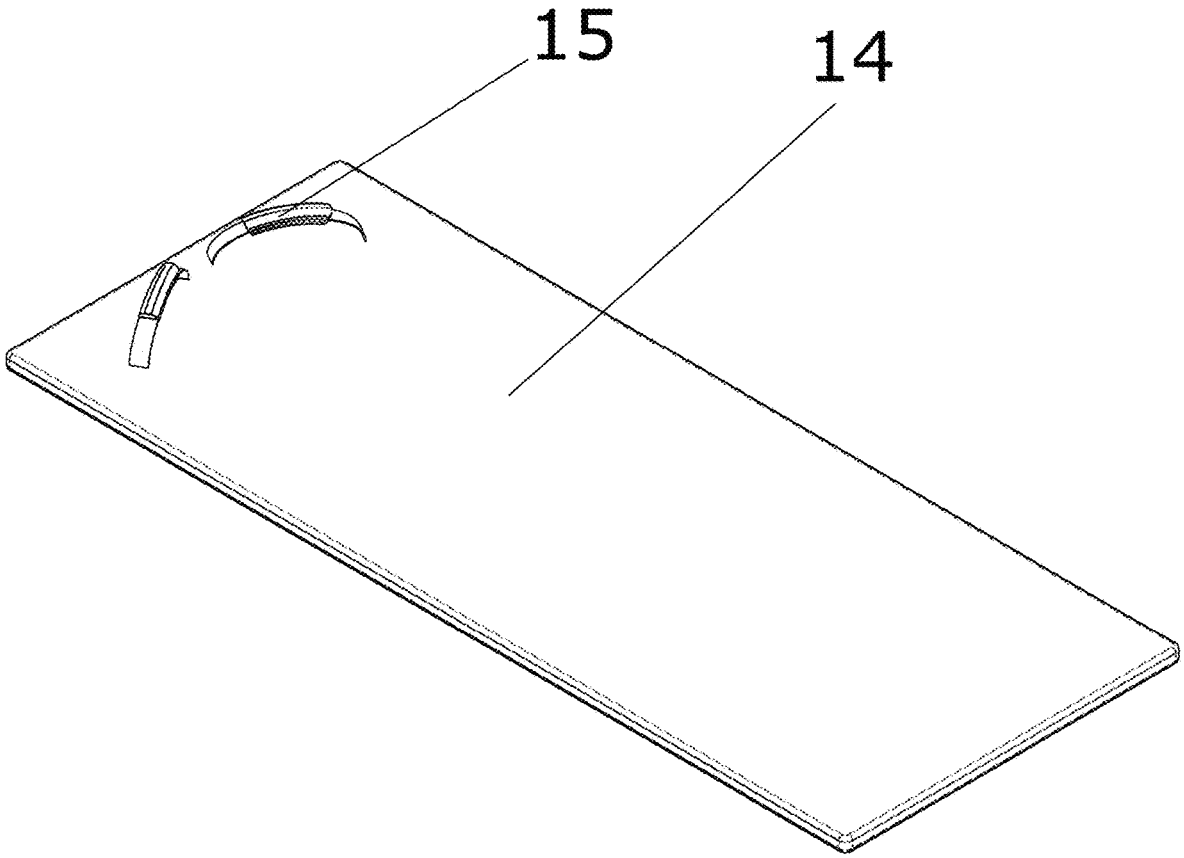

FIG. 3 is a top-perspective view of the sled.

Figure 4:
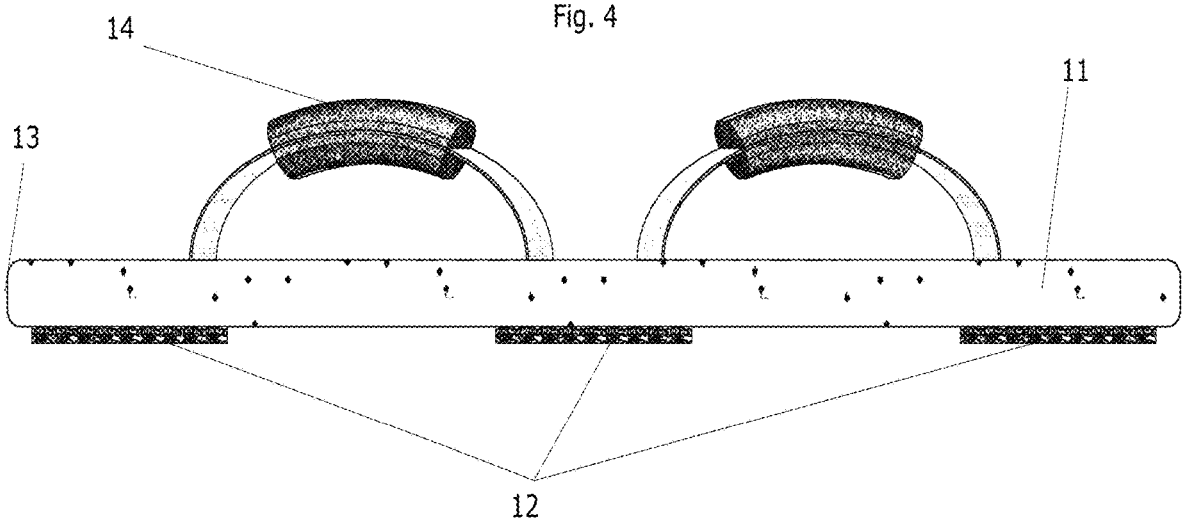

FIG. 4 is the front view of the sled

Figure 5:
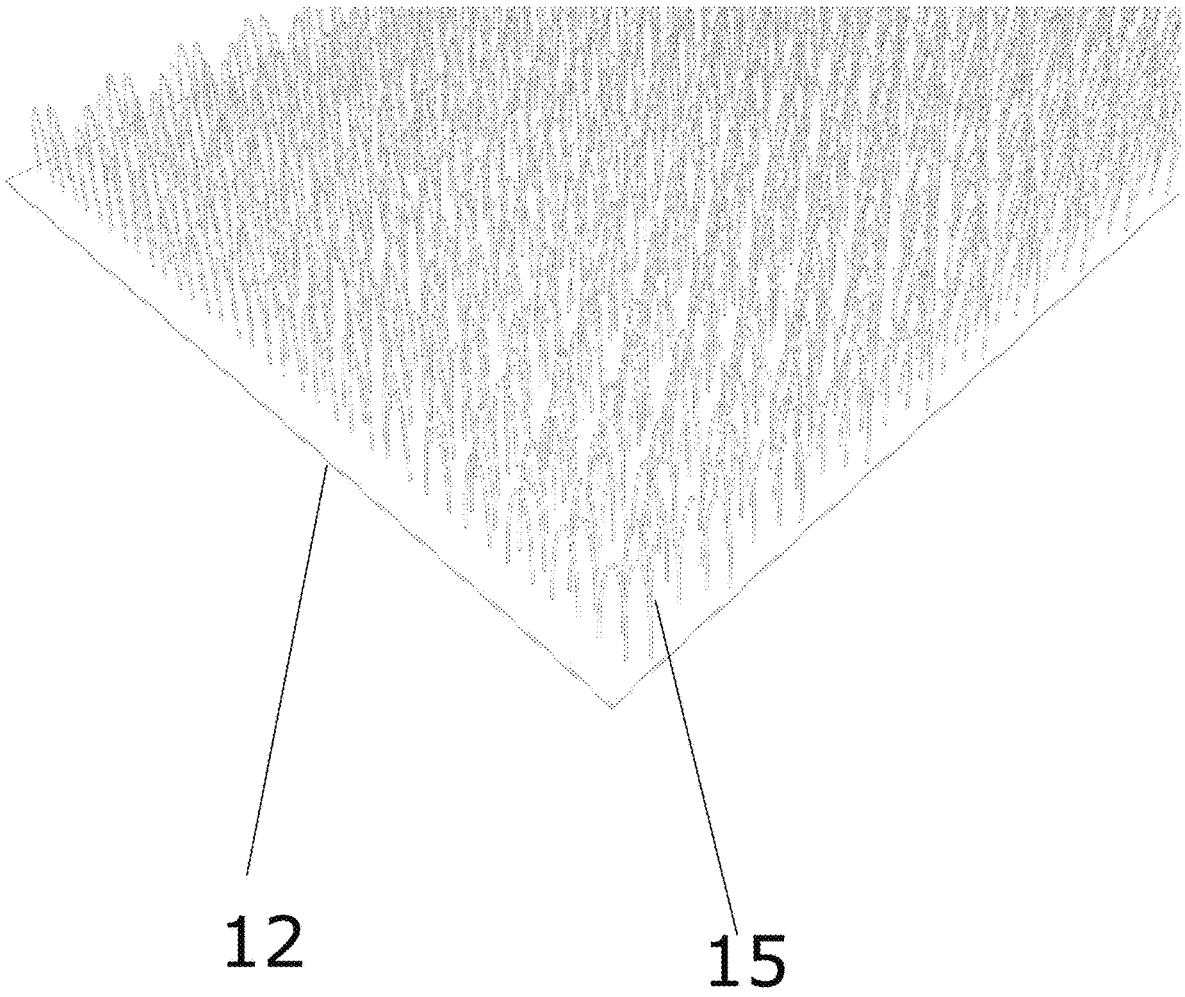

FIG. 5 is a close-up view of the material that makes up the functional contact material of the sled.

Figure 6:
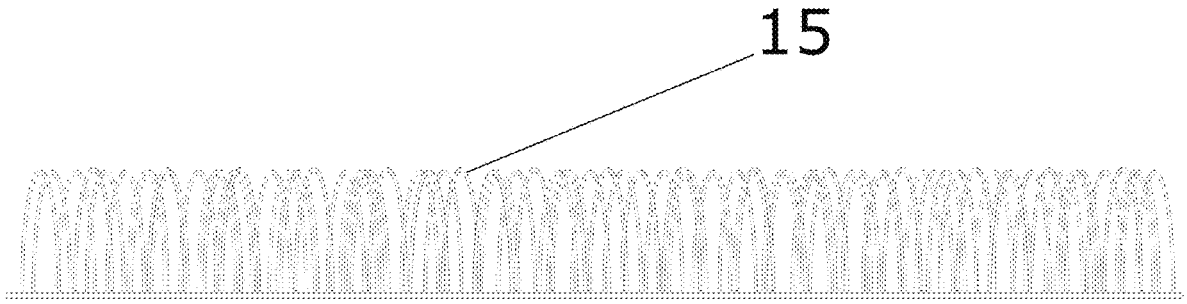

FIG. 6 shows a side view of the functional contact material.

Figure 7:
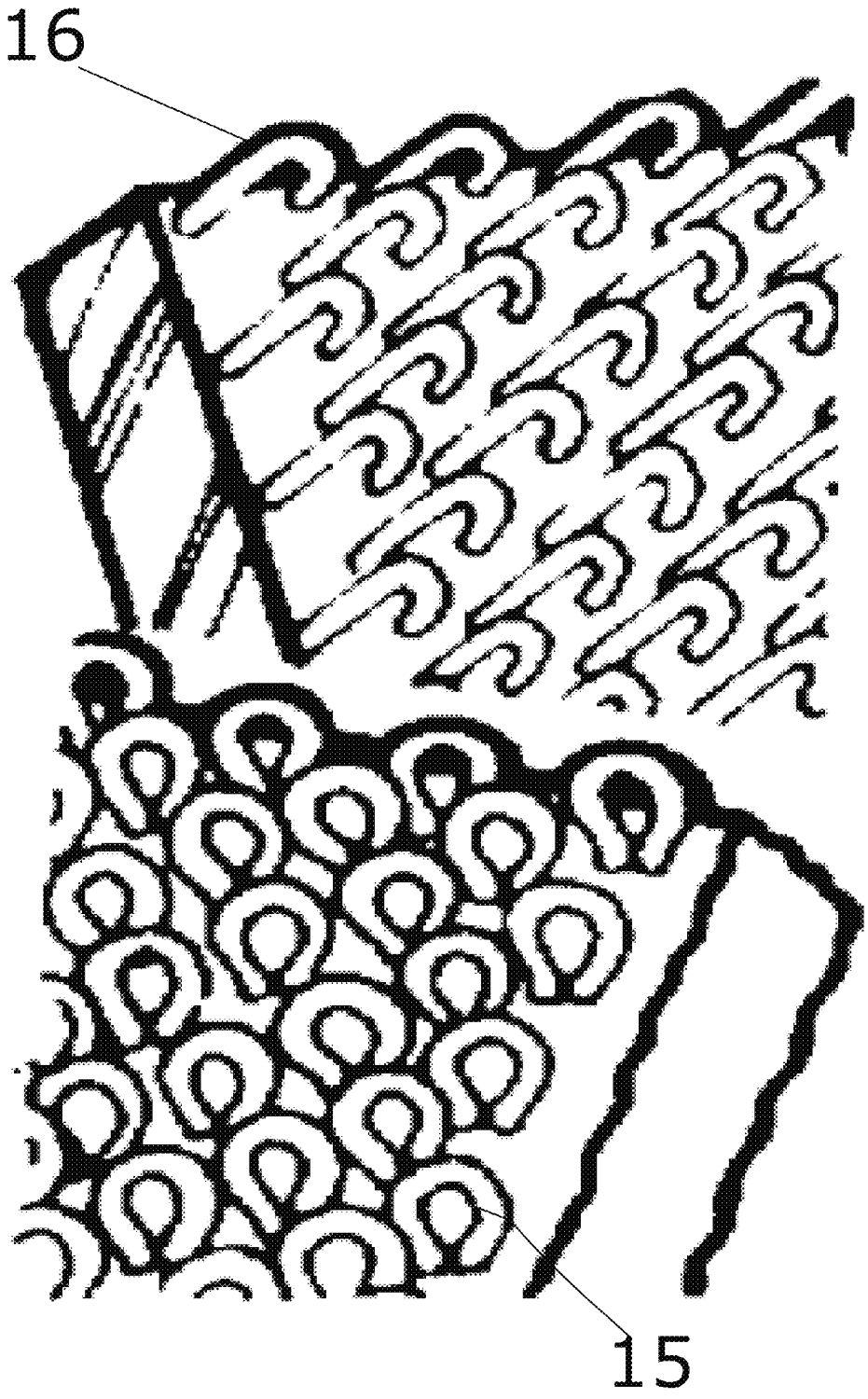

FIG. 7 shows two of the common configurations of the bottom functional contact material.

Figure 8:
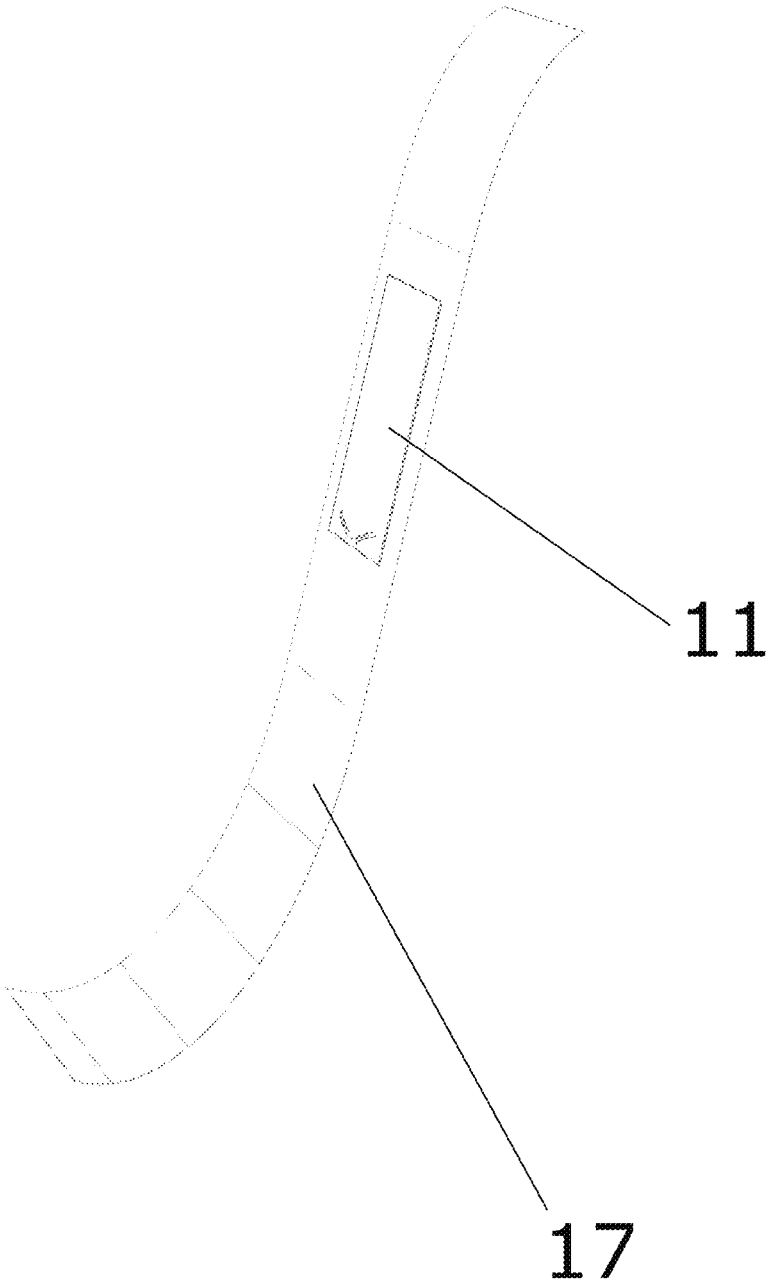

FIG. 8 shows the sled on a slide surface.

Figure 9:
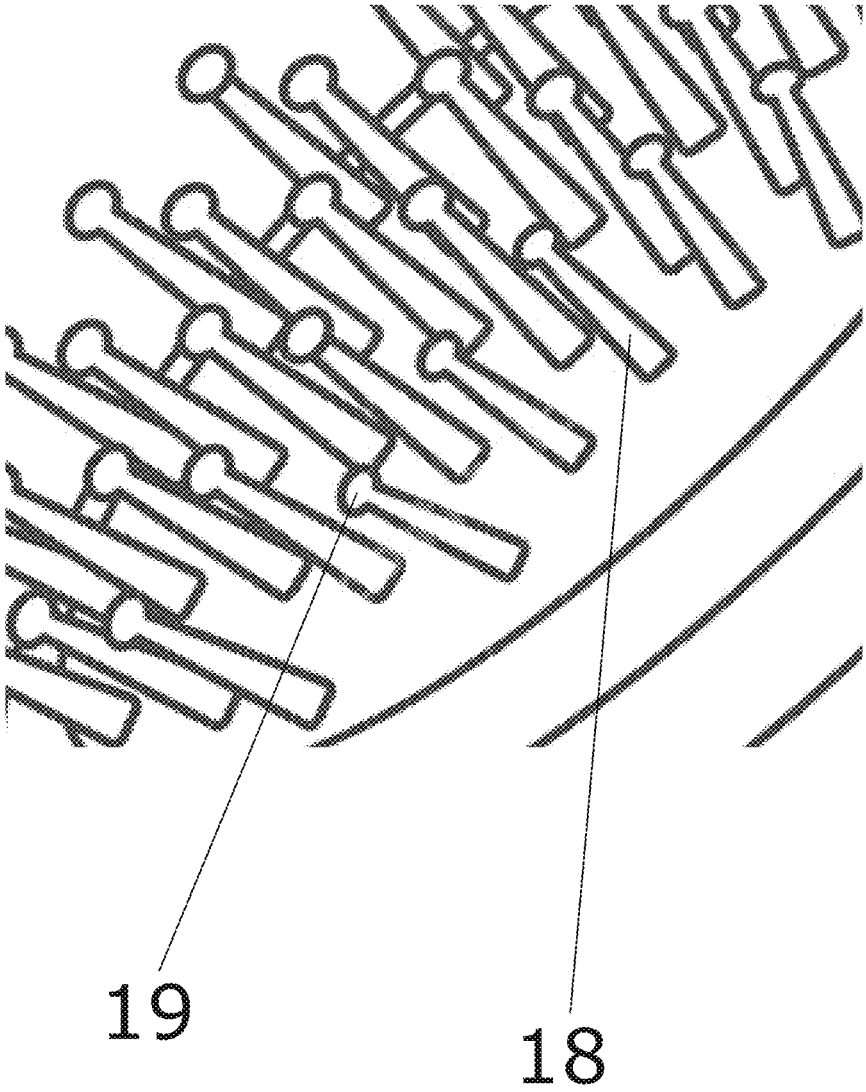

FIG. 9 shows one configuration of the functional contact material.

Figure 10:
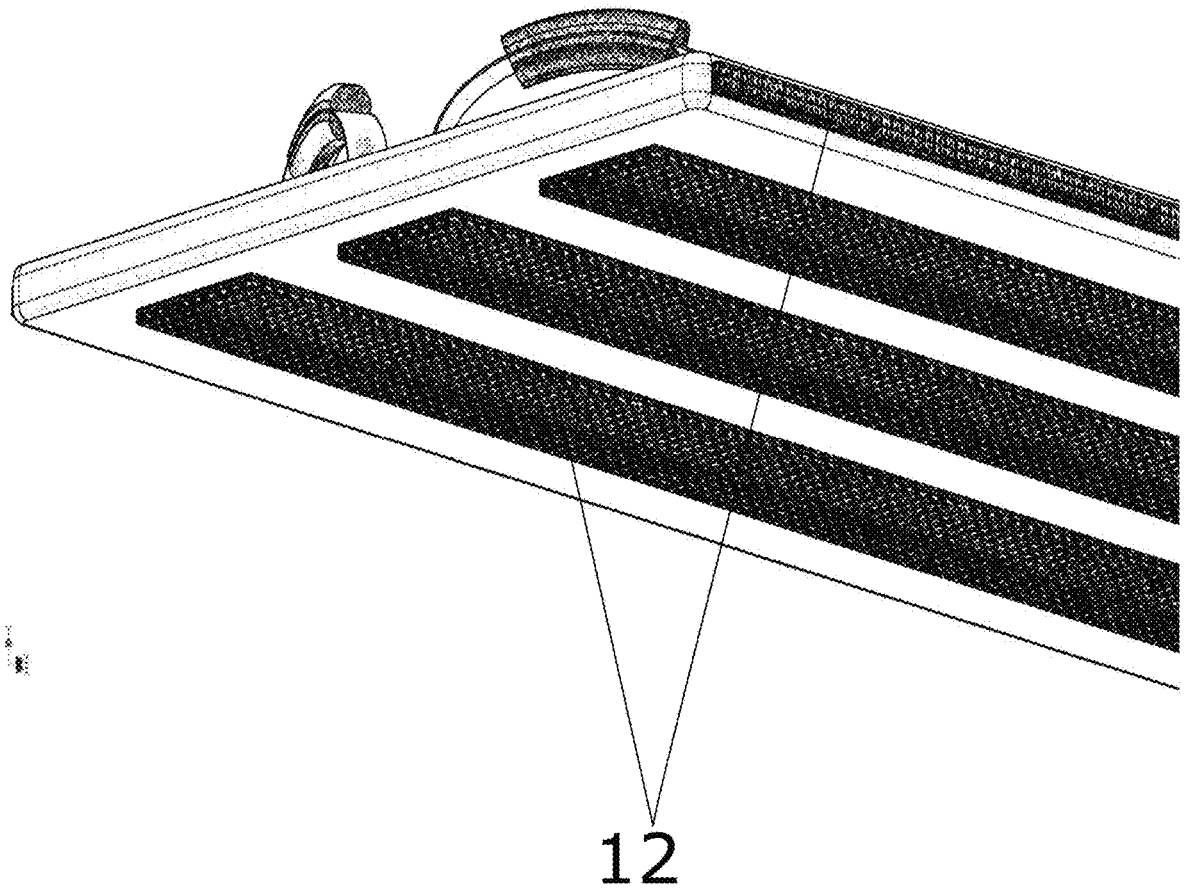

FIG. 10 shows a configuration with the functional contact material on the side of the sled.

Figure 11:
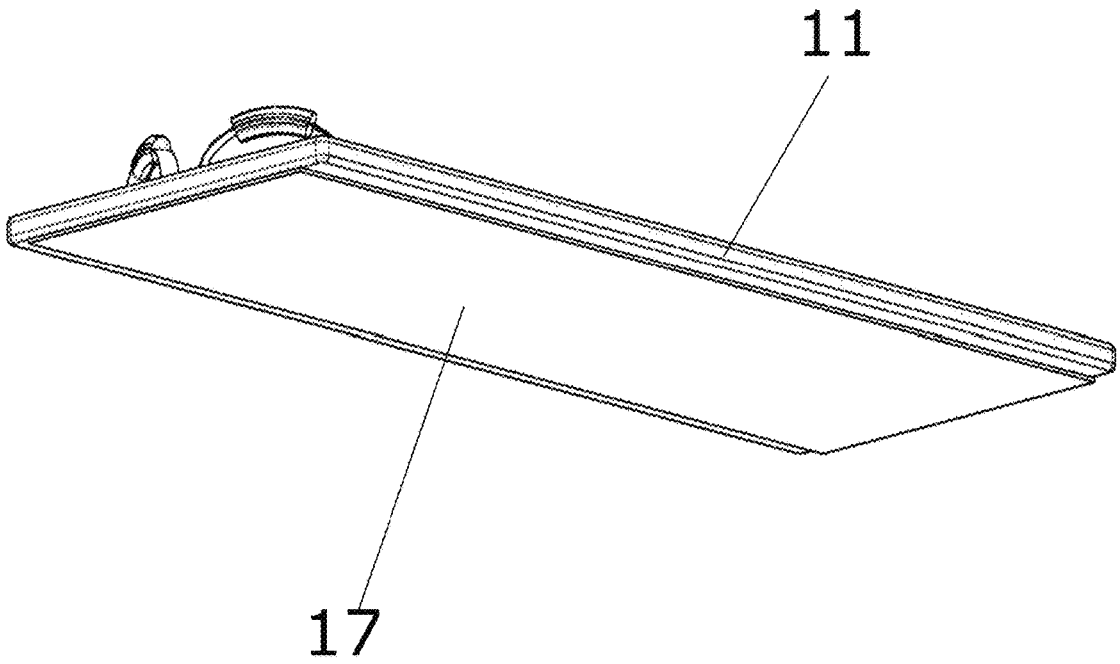

FIG. 11 shows a sled without the functional contact material and instead the smooth slide surface.

Figure 12:
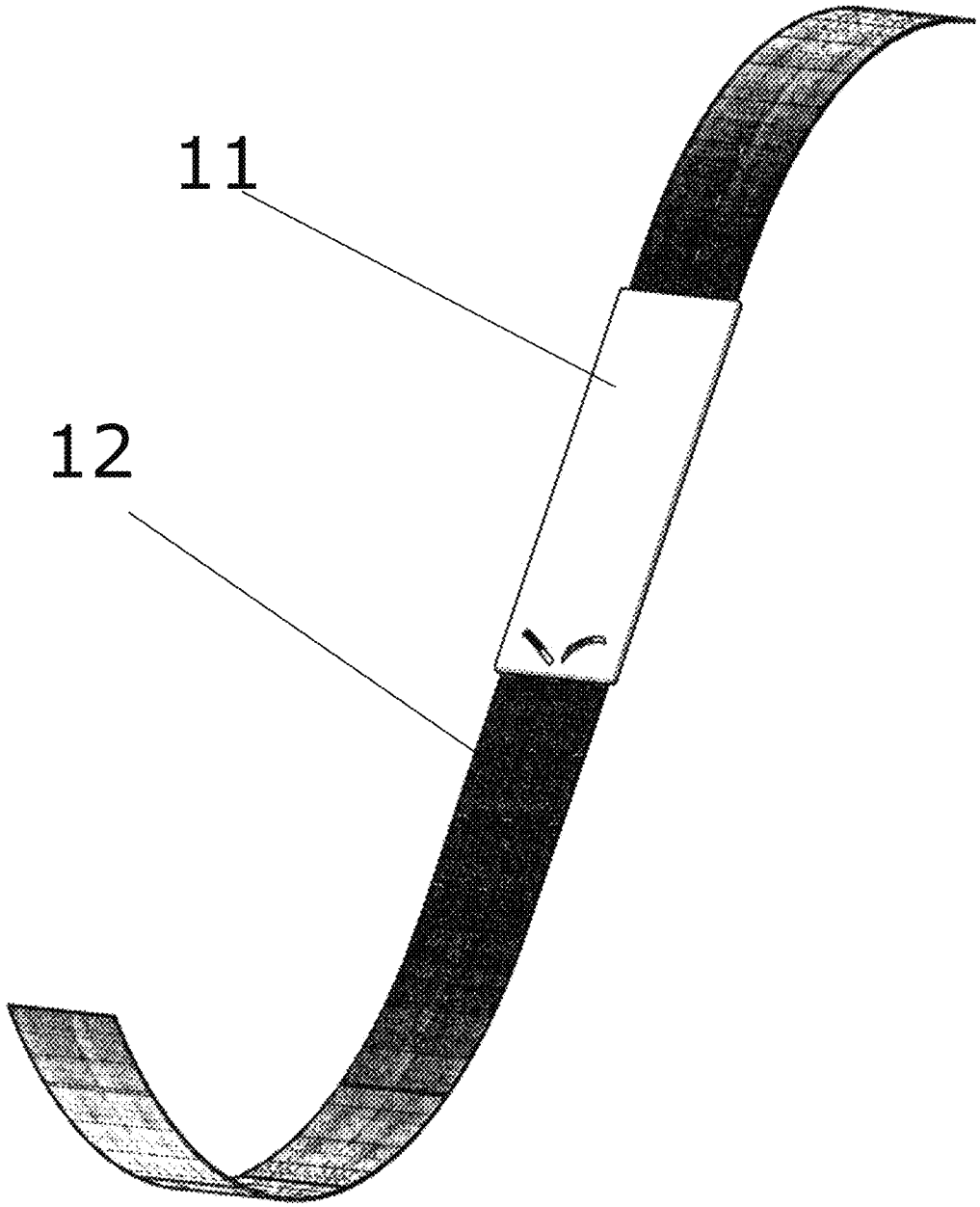

FIG. 12 shows a sled on a slide with the functional contact material on the slide face.

DETAILED DESCRIPTION OF THE PREFERRED EMBODIMENTS

The following detailed description is of the best currently contemplated modes of carrying out exemplary embodiments of the invention. The description is not to be taken in a limiting sense but is made merely for the purpose of illustrating the general principles of the present invention.

The overall invention is the amusement slide-sled combination and specifically the material on the sled bottom 12, the functional contact material, in combination with the material on the slide surface 17, and any geometrical configuration with the sled-slide interaction.

A rider is positioned on the top of the sled 11 which has a functional contact material 12 on the bottom. The functional contact material 12 is comprised of material that has individual extensions generally perpendicular to the horizontal of the material plane, and therefore perpendicular to the slide surface, not unlike a hook and loop fastener material. It should be noted that this is different than a carpet or a rug surface because the protrusions in this invention have a higher stiffness than what is found in a carpet or rug. These extensions 15 can be loops 15, hooks 16, or straight bristle-like structures 18. The bristle-like structures may have a bulbous end 19, or they may just be straight bristles. FIG. 5 shows a close-up of a loop configuration.

Extensions 15, 16, 17, 18, and 19 can be made of any material, including but not limited to nylon, polyurethane, Teflon, Acrylic, Polymethyl Methacrylate (PMMA), Polycarbonate (PC), Polyethylene (PE), Polypropylene (PP), Polyethylene Terephthalate (PETE or PET), Polyvinyl Chloride (PVC), Acrylonitrile-Butadiene-Styrene (ABS). steel, aluminum, or any metal.

The sliding surface 17 may also be any material including but not limited to nylon, polyurethane, Teflon, Acrylic, Polymethyl Methacrylate (PMMA), Polycarbonate (PC), Polyethylene (PE), Polypropylene (PP), Polyethylene Terephthalate (PETE or PET), Polyvinyl Chloride (PVC), Acrylonitrile-Butadiene-Styrene (ABS). steel, aluminum, or any metal.

The functional contact material 12 and the slide surface 17 create a low coefficient of friction, reducing the resistance to the sled traversing the slide. This lower resistance creates a faster slide experience. One advantage to this increased speed is a lower overall height and a lower angle to achieve the same sliding speed.

In one embodiment the slide surface is comprised of the functional contact material 12 and the sled bottom then has the slide surface 17. FIGS. 11 and 12 show this configuration.

In another embodiment, the sides of the sled have the functional contact material 12, this then is a contact surface if the sled touches the side of the slide or if the sled is directed through a channel.

In another embodiment the sled has a geometry that fits into a channel on the slide surface, this geometry is covered with the functional contact material 12.

In one embodiment the functional contact material has very short and wide protrusions creating very stiff protrusions.

The protrusions 15 are connected to the base horizontal material 12 through any connecting means, including but not limited to woven, shared, or laminated.

The functional contact material may include a backing layer having a first surface with an array of upstanding stems (protrusions). The protrusions may be of any density per square inch.

I claim:

1. A sled for an amusement slide comprising a substantially horizontally flat sled with a bottom, top, and sides with a functional contact material on the bottom of the sled comprised of a substantially horizontal plane parallel and attached to the sled bottom, with protrusions extending away from the horizontal plane, wherein the protrusions are configured to facilitate sliding motion of the sled along the slide surface by reducing the friction between the sled and the slide.

2. A sled as in claim 1 further comprised of functional contact material on any of the sides of the sled where the protrusions would be generally perpendicular from the side of the sled.

3. A sled as in claim 1 further comprised of functional contact material with protrusions extending away from the horizontal plane selected from the group consisting of loop protrusions, hooks from hook and loop fasteners having a curved surface oriented to align the curve of the hook against the slide surface, loops from hook and loop fasteners, straight protrusions, straight protrusions with the bulbous ends.

4. A sled as in claim 1 further comprised of functional contact material with protrusions extending away from the horizontal plane selected from the group consisting of a material with low stiffness, high stiffness, low toughness, high toughness, low hardness, or high hardness.

5. A sled as in claim 1 further comprised of functional contact material with the density of protrusions being at least 5 per square inch.

6. A slide for an amusement ride comprising a downward sloping plane comprising a continuous flexible sheet of functional material with protrusions extending generally perpendicular away from the sloping plane.

* * * * *